US007387579B2

(12) United States Patent
Lin et al.

(10) Patent No.: US 7,387,579 B2
(45) **Date of Patent: *Jun. 17, 2008**

(54) GOLF CLUB HEAD

(75) Inventors: Chon-Chen Lin, Ping-Tung Hsien (TW); Shun-Fu Hu, Ping-Tung Hsien (TW); Yen-Chi Hsu, Ping-Tung Hsien (TW)

(73) Assignee: O-Ta Precision Industry Co., Inc., Ping-Tung Hsien (TW)

( * ) Notice: Subject to any disclaimer, the term of this patent is extended or adjusted under 35 U.S.C. 154(b) by 8 days.

This patent is subject to a terminal disclaimer.

(21) Appl. No.: 11/476,031

(22) Filed: Jun. 28, 2006

(65) Prior Publication Data

US 2008/0004130 A1 Jan. 3, 2008

(51) Int. Cl.
*A63B 53/04* (2006.01)

(52) U.S. Cl. ..... 473/332; 473/342; 473/346; 473/349

(58) Field of Classification Search ..... 473/324–350, 473/287–292

See application file for complete search history.

(56) References Cited

U.S. PATENT DOCUMENTS 5,195,747 A * 3/1993 Choy ..... 473/333
5,316,298 A * 5/1994 Hutin et al. ..... 473/332
5,409,229 A * 4/1995 Schmidt et al. ..... 473/332
5,586,947 A * 12/1996 Hutin ..... 473/324
5,595,552 A * 1/1997 Wright et al. ..... 473/332
5,697,855 A * 12/1997 Aizawa ..... 473/350
5,707,302 A * 1/1998 Leon et al. ..... 473/324
5,993,331 A * 11/1999 Shieh ..... 473/342
6,379,262 B1 * 4/2002 Boone ..... 473/324
6,688,989 B2 * 2/2004 Best ..... 473/332
6,743,117 B2 * 6/2004 Gilbert ..... 473/332
6,840,872 B2 * 1/2005 Yoneyama ..... 473/346
6,849,005 B2 * 2/2005 Rife ..... 473/350
6,899,638 B2 * 5/2005 Iwata et al. ..... 473/329
2007/0026965 A1 * 2/2007 Huang ..... 473/342
2007/0117653 A1 * 5/2007 Yoneyama ..... 473/350

* cited by examiner

*Primary Examiner*—Sebastiano Passaniti
(74) *Attorney, Agent, or Firm*—Foley & Lardner LLP

(57) ABSTRACT

A golf club head includes a head body having a front opening, a striking plate member covering the front opening, and at least one vibration-absorbing element. The striking plate member includes a striking face with a striking zone, and a back face opposite to the striking face and having a receiving groove. The vibration-absorbing element is disposed in the receiving groove.

8 Claims, 7 Drawing Sheets

GOLF CLUB HEAD

BACKGROUND OF THE INVENTION

1. Field of the Invention

The invention relates to a golf club head, more particularly to a golf club head that has a good vibration-absorbing effect.

2. Description of the Related Art

Referring to FIGS. 1 and 2, a conventional golf club head 1 includes a head body 11 having a front opening 111, and a striking plate 12 covering the front opening 111 for striking a golf ball (not shown). Since the conventional golf club head 1 is not provided with a vibration-absorbing element, when a player strikes the ball with a large swinging force, a substantial impact force is absorbed by the striking plate 12, such that an intense vibration is produced. This intense vibration can make it difficult to hit the ball accurately. Further, the intense vibration is transmitted to the player's hands which may bring discomfort to the player. Such transmission of vibration may be especially acute when the player is using a wood.

Referring to FIG. 3, another conventional golf club head 2, as disclosed in Taiwanese Patent No. M240256, includes a head body 21, and a striking plate 22 fixed to a front end face of the head body 21. A receiving space 23 is formed in a bottom portion of the head body 21 adjacent to the striking plate 22. Fluid 24 is filled into the receiving space 23 to serve as a vibration-absorbing element. The fluid 24 in the receiving space 23 produces a viscous force that dampens the vibration produced during striking of the ball.

Although the conventional golf club head 2 of FIG. 3 can achieve a vibration-absorbing effect, the fluid 24 may leak out from the receiving space 23 during use of the golf club head 2 over time. Further, such a configuration of the conventional golf club head 2 is difficult to produce, so that the cost to produce the same is high. Moreover, during swinging of a golf club incorporating the golf club head 2, because of the movement of the fluid 24 in the receiving space 23, a delayed condition is produced, which reduces stability during hitting of the ball.

SUMMARY OF THE INVENTION

Therefore, the object of the present invention is to provide a golf club head that can be produced at a minimum cost, and that can absorb vibration during hitting of a golf ball so that a player can control stably a striking direction of the golf ball and so that any feelings of discomfort given to the player as a result of receiving the transmission of vibration can be reduced.

According to this invention, a golf club head comprises a head body having a front opening, a striking plate member covering the front opening, and at least one vibration-absorbing element. The striking plate member includes a striking face with a striking zone, and a back face opposite to the striking face and having a receiving groove. The vibration-absorbing element is disposed in the receiving groove.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
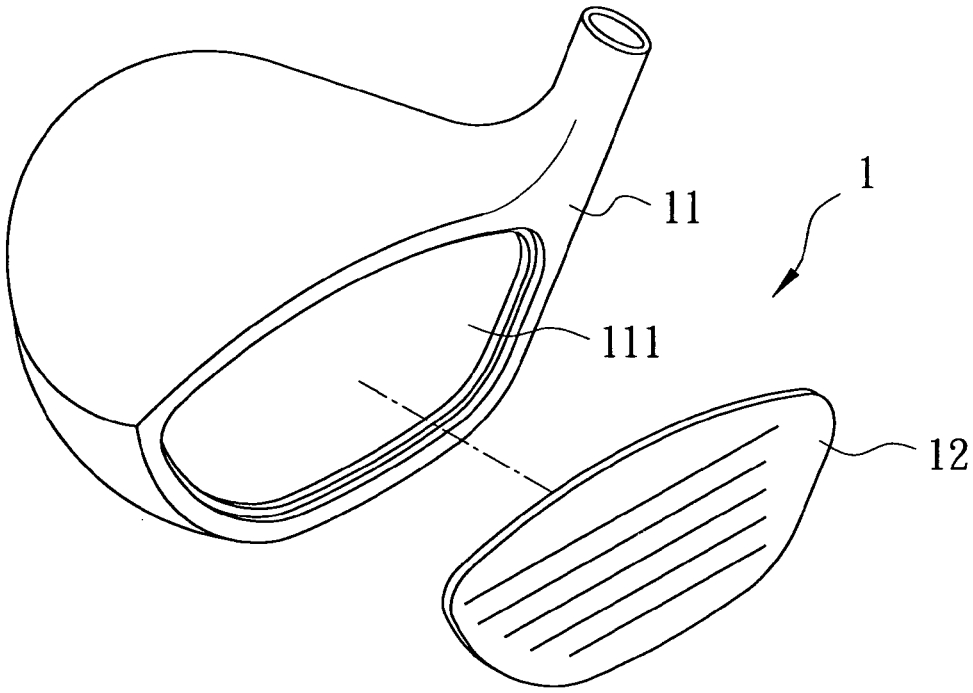
FIG. 1 PRIOR ART
FIG. 1 is an exploded perspective view of a conventional golf club head.
Figure 2:
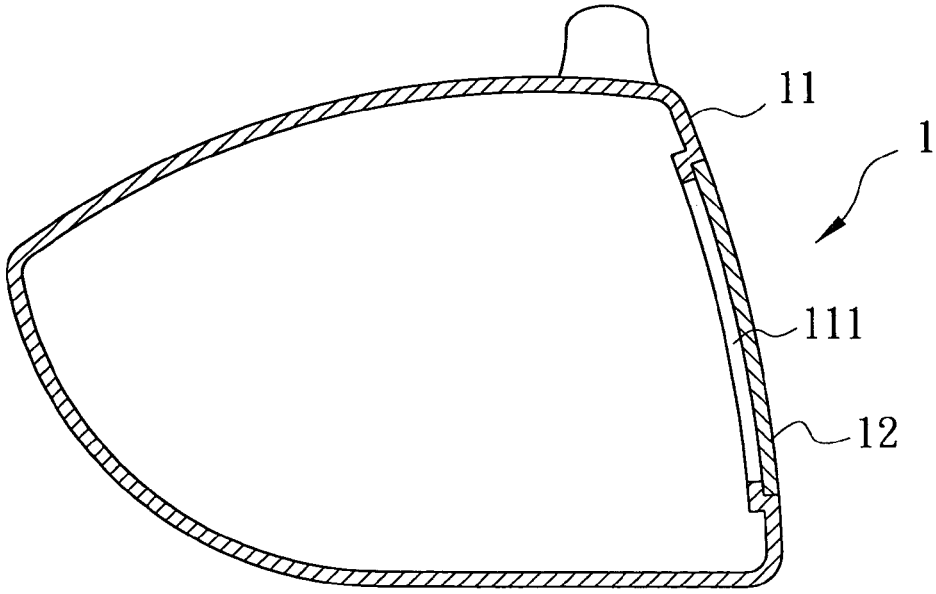
FIG. 2 PRIOR ART
FIG. 2 is an assembled sectional view of the conventional golf club head of FIG. 1.
Figure 3:
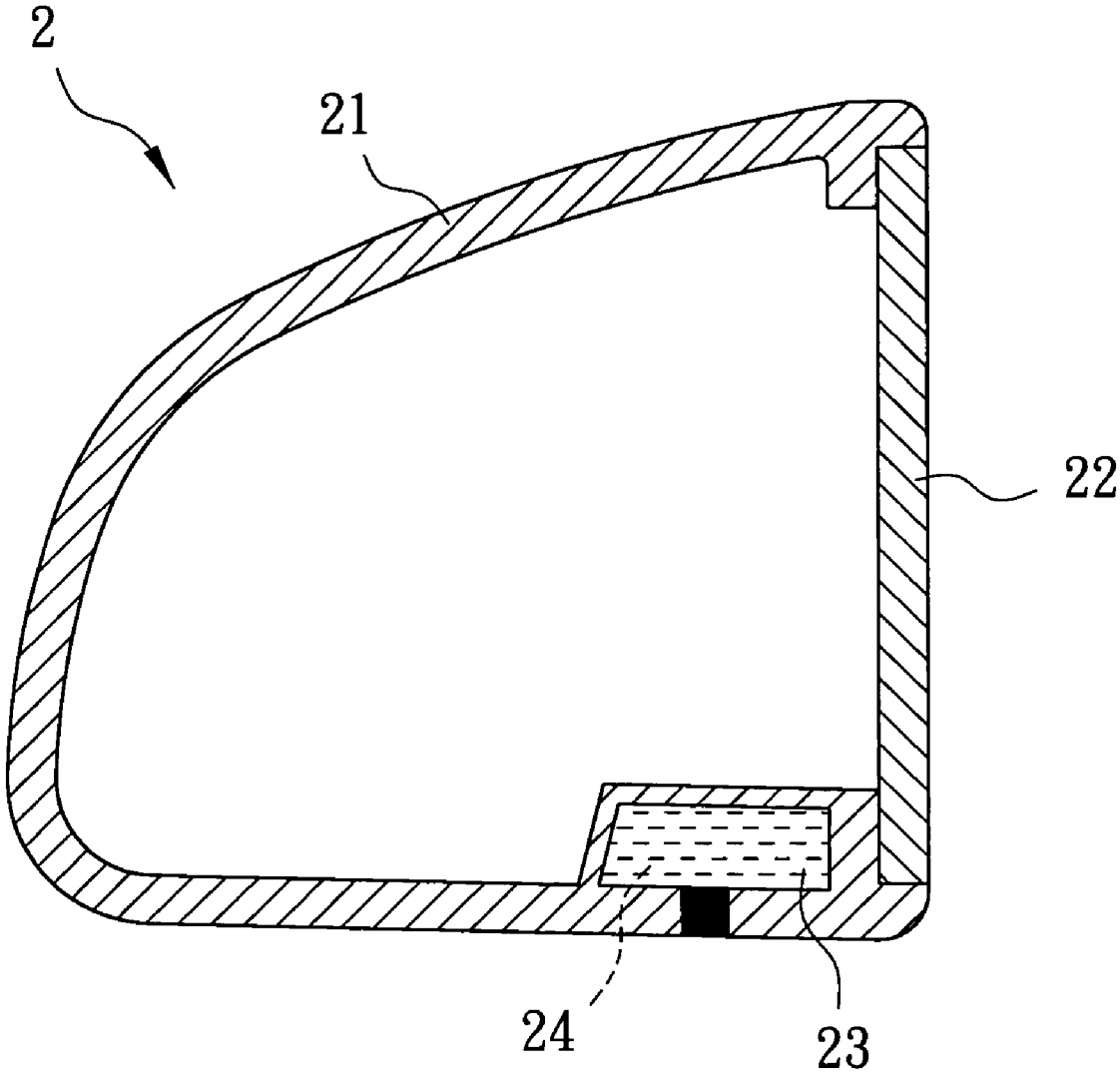
FIG. 3 PRIOR ART
FIG. 3 is an assembled sectional view of a conventional golf club head disclosed in Taiwanese Patent No. M240256.

Before the present invention is described in greater detail, it should be noted that like elements are denoted by the same reference numerals throughout the disclosure.

Figure 4:
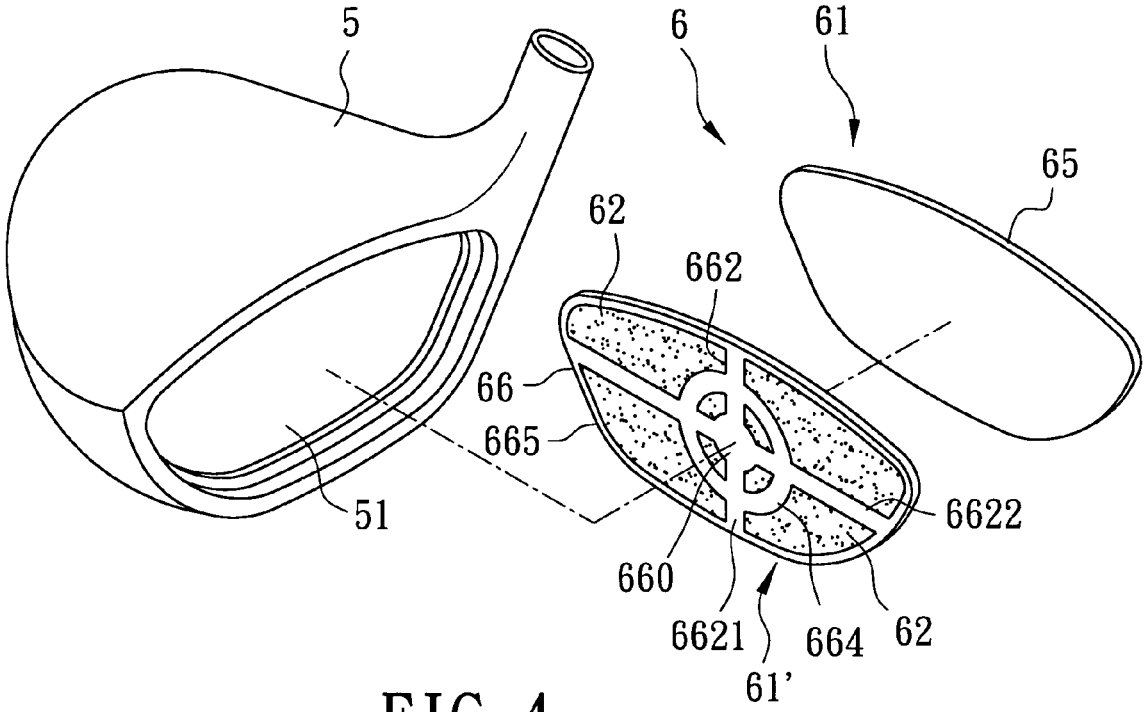
FIG. 4 is an exploded perspective view of the first preferred embodiment of a golf club head according to the present invention.
Figure 5:
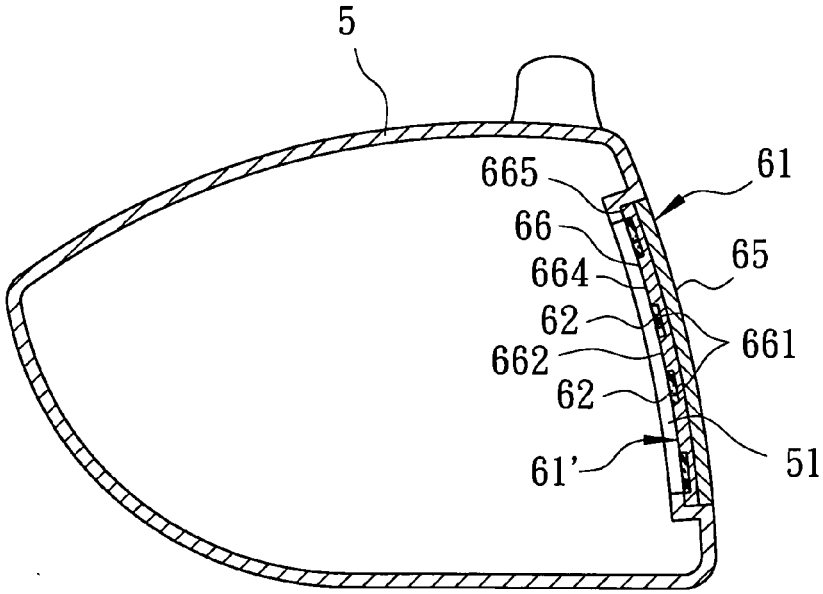
FIG. 5 is an assembled sectional view of the first preferred embodiment.

Referring to FIGS. 4 and 5, the first preferred embodiment of a golf club head according to the present invention is adapted to be applied to a wood, and is shown to comprise a head body 5 having a front opening 51, a striking plate member 6, and a plurality of vibration-absorbing elements 62.

The striking plate member 6 includes a front plate 61 and a back plate 61'. The front plate 61 is made of a titanium alloy, has a striking face 65 adapted to strike a golf ball (not shown), and a thickness of about 0.5 mm. By using a titanium alloy, the front plate 61 not only is light in weight, but also is durable.

The back plate 61' is connected face-to-face with the front plate 61, and has a back face 66. The back face 66 has an outer peripheral flange 665 that projects rearwardly from the back face 66 along an outer periphery of the back face 66, an annular reinforcing rib 664 formed on the back face 66 within the outer peripheral flange 665, a central boss 660 formed concentrically within the annular reinforcing rib 664, and a plurality of angularly spaced-apart diametral reinforcing ribs 662 extending diametrically through the central boss 660 and the annular reinforcing rib 664. The outer peripheral flange 665, the annular reinforcing rib 664, and the diametral reinforcing ribs 662 cooperate to define a plurality of receiving grooves 661.

The back plate 61' is made of a light and high strength metal. In this embodiment, the back plate 61' is made of a magnesium alloy. Alternatively, the back plate 61' maybe made of an alloy selected from the group consisting of an aluminum-magnesium alloy, an aluminum alloy, and an aluminum-scandium alloy.

The front and back plates 61, 61' have substantially identical outer profiles. In this embodiment, the front and back plates 61, 61' are secured to each other through an adhesive. Alternatively, the front and back plates 61, 61' may be welded to each other, or may be connected to each other using other conventional connecting methods.

The diametral reinforcing ribs 662 include a substantially vertical reinforcing rib 6621 and a substantially horizontal reinforcing rib 6622 that intersect each other perpendicularly. In an alternative embodiment, the vertical and horizontal reinforcing ribs 6621, 6622 may intersect each other obliquely. Each of the vertical and horizontal reinforcing ribs 6621, 6622 has two opposite ends connected to the outer peripheral flange 665.

The annular reinforcing rib 664 is located behind a striking zone or sweet spot of the striking face 65 so as to strengthen the structure of the striking zone and so as to absorb the vibration produced by the striking zone when hitting the golf ball. Alternatively, the area of the annular reinforcing rib 664 may be expanded so as to further protect areas outside the striking zone.

The vibration-absorbing elements 62 are disposed respectively in the receiving grooves 661. Each vibration-absorbing element 62 is made of a material selected from the group consisting of thermoplastic polyurethane, silicone, and natural rubber. Alternatively, each vibration-absorbing element 62 may be made of a non-alloyed metal selected from the group consisting of aluminum, magnesium, copper, zinc, and tin. As long as the material can achieve a sufficient vibration-absorbing effect, it is suitable for disposal in the corresponding receiving groove 661.

When the golf club head of the present invention strikes the golf ball, in addition to the reinforcement provided to the structure of the back plate 61' by the vertical and horizontal reinforcing ribs 6621, 6622, the annular reinforcing rib 664, and the outer peripheral flange 665, the golf club head of the present invention further uses the vibration-absorbing elements 62 in the respective grooves 661 to absorb the vibration produced during hitting of the golf ball. Moreover, use of a magnesium alloy enhances the ability of the back plate 61' to absorb an impact force produced when the striking face 65 hits the ball so that the impact force can be directly, quickly, and effectively absorbed by the vibration-absorbing elements 62. As such, the vibration that is transferred to the player's hands is minimized, and the player can stably and accurately strike the golf ball in a desired direction.

Figure 6:
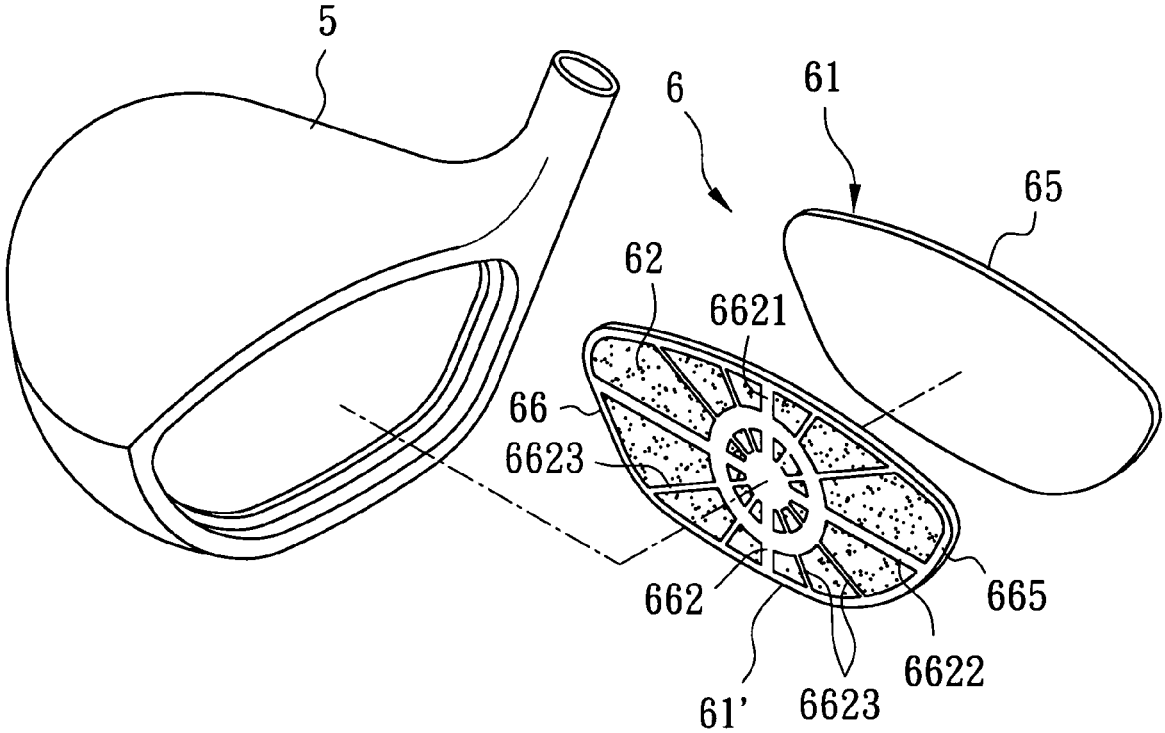
FIG. 6 is an exploded perspective view of the second preferred embodiment of a golf club head according to the present invention.

Referring to FIG. 6, the second preferred embodiment of a golf club head according to the present invention is shown to be similar to the first preferred embodiment. However, in this embodiment, the diametral reinforcing ribs 662 further include a plurality of angularly spaced-apart oblique reinforcing ribs 6623 that intersect the vertical and horizontal reinforcing ribs 6621, 6622 obliquely. The oblique reinforcing ribs 6623 similarly strengthen the structure of the back plate 61'. In this embodiment, there are four oblique reinforcing ribs 6623 intersecting the vertical and horizontal reinforcing ribs 6621, 6622. Each oblique reinforcing rib 6623 is thinner than the vertical and horizontal reinforcing ribs 6621, 6622. Thicknesses of and spacing between the oblique reinforcing ribs 6623 may be adjusted accordingly depending on the expected amount of force to be absorbed.

Figure 7:
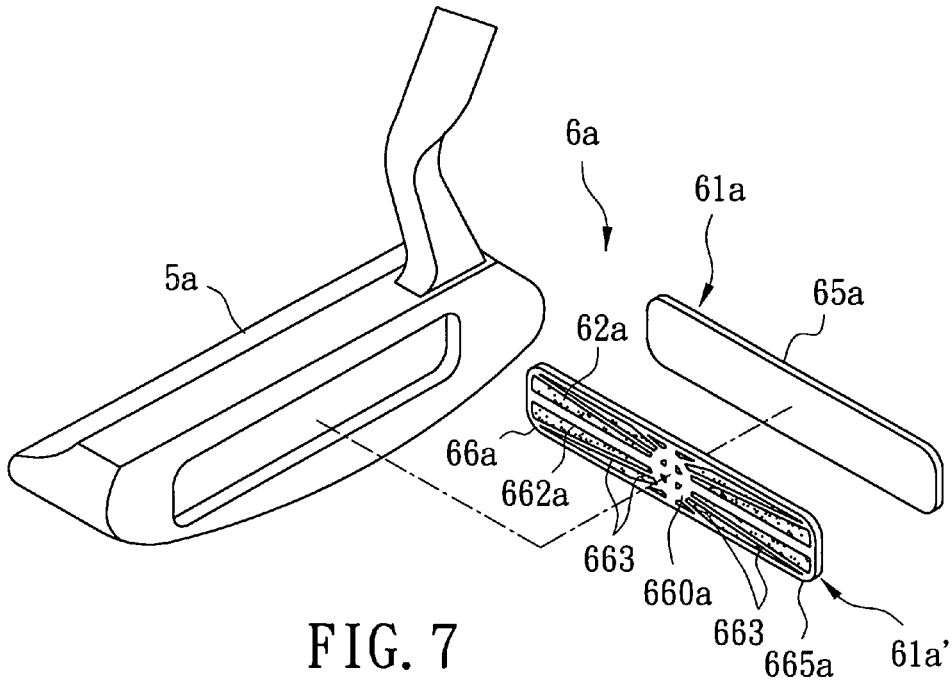
FIG. 7 is an exploded perspective view of the third preferred embodiment of a golf club head according to the present invention.

Referring to FIG. 7, the third preferred embodiment of a golf club head according to the present invention is shown to be similar to the first preferred embodiment. However, in this embodiment, the striking plate member (6*a*) is adapted to be applied to a putter. The diametral reinforcing ribs (662*a*) further include a plurality of angularly spaced-apart oblique reinforcing ribs 663 that extend from the annular reinforcing rib (660*a*) toward the outer peripheral flange (665*a*). Vibration produced during putting of the golf ball can be similarly absorbed by the back plate (61*a*') and the vibration-absorbing elements (62*a*) in the back plate (61*a*') so that stability during putting is enhanced.

Figure 8:
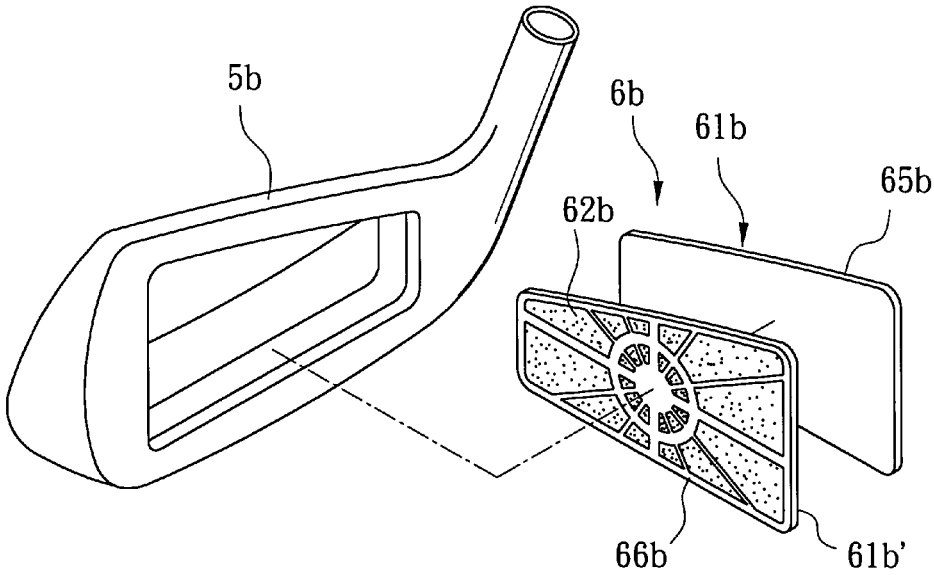
FIG. 8 is an exploded perspective view of the fourth preferred embodiment of a golf club head according to the present invention.

Referring to FIG. 8, the fourth preferred embodiment of a golf club head according to the present invention is shown to be similar to the second preferred embodiment. However, in this embodiment, the striking plate member (6*b*) is adapted to be applied to an iron. The advantages of the second preferred embodiment can be similarly attained using the fourth preferred embodiment.

Figure 9:
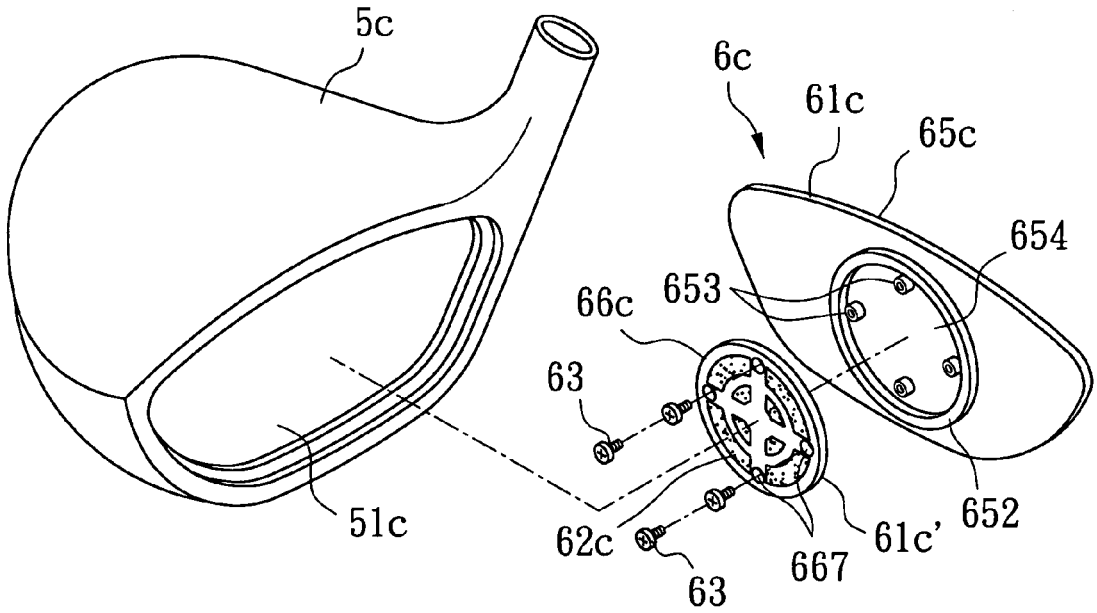
FIG. 9 is an exploded perspective view of the fifth preferred embodiment of a golf club head according to the present invention.
Figure 10:
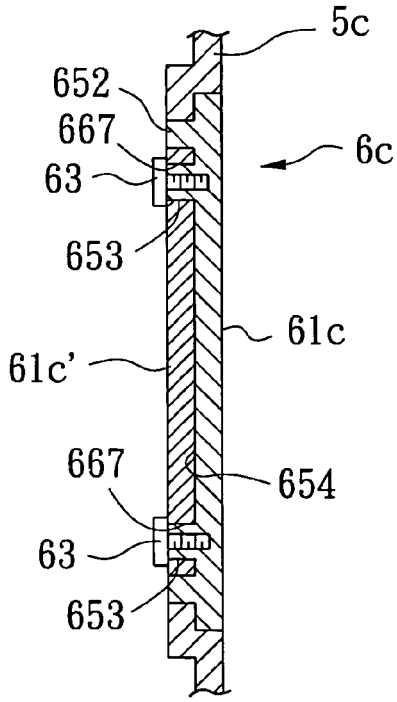
FIG. 10 is a fragmentary assembled sectional view of the fifth preferred embodiment.

Referring to FIGS. 9 and 10, the fifth preferred embodiment of a golf club head according to the present invention is shown to be similar to the first preferred embodiment. However, in this embodiment, the front plate (61*c*) has a ring 652 projecting rearwardly from a rear side thereof and defining an indentation 654 to receive the back plate (61*c*'). Four angularly spaced-apart studs 653 are provided on the front plate (61*c*) and project rearwardly from the rear side of the front plate (61*c*) within the ring 652. The back plate (61*c*') is disposed within the indentation 654, and has a plurality of spaced-apart through holes 667 to receive respectively the studs 653, and a plurality of fasteners 63 attached respectively to the studs 653 after the studs 653 extend into the through holes 667, respectively.

In this embodiment, each stud 653 has an internally extending threaded hole. The fasteners 63 are configured as screws that engage respectively and threadedly the internally extending threaded holes in the studs 653, so that the back plate (61*c*') is stably connected within the indentation 654 of the front plate (61*c*).

Figure 11:
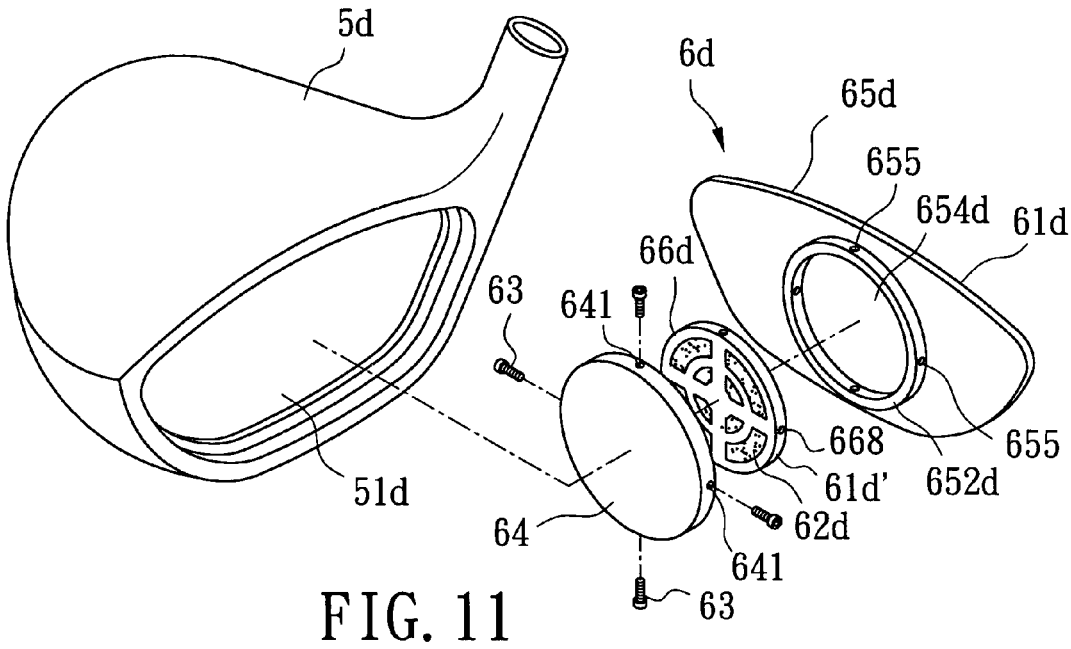
FIG. 11 is an exploded perspective view of the sixth preferred embodiment of a golf club head according to the present invention.
Figure 12:
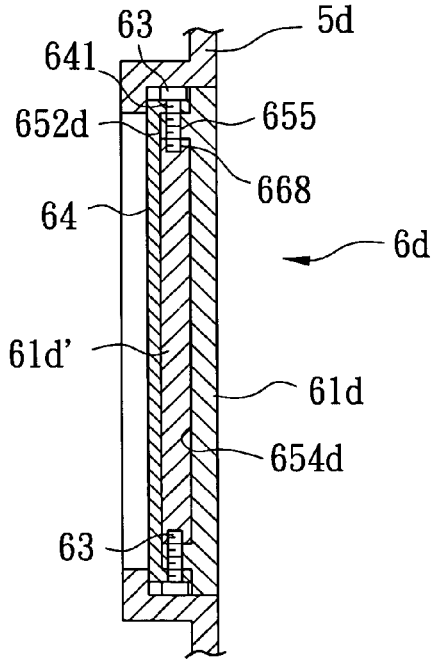
FIG. 12 is a fragmentary assembled sectional view of the sixth preferred embodiment.

Referring to FIGS. 11 and 12, the sixth preferred embodiment of a golf club head according to the present invention is shown to be similar to the fifth preferred embodiment. However, in this embodiment, the striking plate member (6*d*) further includes a cover plate 64 connected to the ring (652*d*) for covering the back plate (61*d*') and having four angularly spaced-apart through holes 641. An outer periphery of the cover plate 64 is formed with the through holes 641 and is fitted over the ring (652*d*). The front plate (61*d*) further has four angularly spaced-apart radial through holes 655 formed in the ring (652*d*). The back plate (61*d*') is provided with four angularly spaced-apart screw holes 668. Four fasteners 63 are extended respectively through the through holes 641 in the cover plate 64 and the radial through holes 655 in the ring 652, and are engaged respectively to the screw holes 668 in the back plate (61*d*') so as to fasten the cover plate 64 to the ring (652*d*), so that the back plate (61*d*') is stably connected within the indentation (654*d*) of the front plate (61*d*).

From the aforementioned description, it is apparent that the golf club head of the present invention is provided with the vibration-absorbing elements (62, 62*a*, 62*b*, 62*c*, 62*d*) in the back face (66, 66*a*, 66*b*, 66*c*, 66*d*) of the back plate (61', 61*a*', 61*b*', 61*c*', 61*d*'), so that the vibration produced during striking of the golf ball by the player can be directly and quickly transmitted to the back face (66, 66*a*, 66*b*, 66*c*, 66*d*) and absorbed by the vibration-absorbing elements (62, 62*a*, 62*b*, 62*c*, 62*d*), thereby minimizing the effect of vibration on the accurate swinging of the golf club. Because the vibration that is transmitted to the player's hands is minimized, any feelings of discomfort given to the player are reduced. Further, because each vibration-absorbing element (62, 62*a*, 62*b*, 62*c*, 62*d*) of the present invention is made of a solid material, e.g., thermoplastic polyurethane, silicone, or natural rubber, the problem of leakage encountered in the aforementioned conventional golf club head does not occur in the present invention. Moreover, the overall structure of the golf club head of the present invention is simple, so that its production costs are minimized.

While the present invention has been described in connection with what is considered the most practical and preferred embodiments, it is understood that this invention is not limited to the disclosed embodiments but is intended to cover various arrangements included within the spirit and scope of the broadest interpretation so as to encompass all such modifications and equivalent arrangements.

We claim:

1. A golf club head comprising:

a head body having a front opening;

a striking plate member covering said front opening, and including a front plate having a striking face with a striking zone, and a back plate connected face-to-face with said front plate and having a back face with a plurality of receiving grooves; and a plurality of vibration-absorbing elements disposed respectively in said receiving grooves;

wherein said back face has an annular reinforcing rib formed thereon behind said striking zone and corresponding in position to said striking zone, a central boss formed concentrically within said annular reinforcing rib, and a plurality of angularly spaced-apart diametral reinforcing ribs extending diametrically through said central boss and said annular reinforcing rib, said annular reinforcing rib and said diametral reinforcing ribs cooperating to define said receiving grooves.

2. The golf club head of claim 1, wherein said diametral reinforcing ribs include a substantially vertical reinforcing rib and a substantially horizontal reinforcing rib that intersect each other perpendicularly.

3. The golf club head of claim 2, wherein said diametral reinforcing ribs further include a plurality of angularly spaced-apart oblique reinforcing ribs that intersect said vertical reinforcing rib obliquely.

4. The golf club head of claim 1, wherein said front plate has a ring projecting rearwardly from a rear side of said front plate and defining an indentation to receive said back plate.

5. The golf club head of claim 4, wherein said front plate further has a plurality of angularly spaced-apart studs projecting rearwardly from said rear side, said back plate having a plurality of spaced-apart through holes to receive respectively said studs, and a plurality of fasteners fixed respectively to said studs.

6. The golf club head of claim 4, wherein said front plate further has a plurality of angularly spaced-apart radial through holes formed in said ring, said striking plate member further including a cover plate attached to said ring and covering said back plate, and a plurality of fasteners each extending through one of said radial through holes to fasten said cover plate to said ring.

7. The golf club head of claim 1, wherein said back plate is made of an alloy selected from the group consisting of a magnesium alloy, an aluminum-magnesium alloy, an aluminum alloy, and an aluminum-scandium alloy.

8. The golf club head of claim 1, wherein each of said vibration-absorbing elements is made of a material selected from the group consisting of thermoplastic polyurethane, silicone, natural rubber, and a soft metal.

* * * * *